US010896637B2

(12) United States Patent
Kim et al.

(10) Patent No.: US 10,896,637 B2
(45) **Date of Patent: *Jan. 19, 2021**

(54) METHOD OF DRIVING ORGANIC LIGHT EMITTING DISPLAY DEVICE

(71) Applicant: LG Display Co., Ltd., Seoul (KR)

(72) Inventors: Nari Kim, Gyeonggi-do (KR); Seung Tae Kim, Gyeonggi-do (KR); Tae Gung Kim, Gyeonggi-do (KR); Ji Eun Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/717,146

(22) Filed: Sep. 27, 2017

(65) Prior Publication Data

US 2018/0018915 A1 Jan. 18, 2018

Related U.S. Application Data

(63) Continuation of application No. 14/108,356, filed on Dec. 17, 2013, now Pat. No. 9,805,642.

(30) Foreign Application Priority Data

Dec. 20, 2012 (KR) ..... 10-2012-0149827

(51) Int. Cl.
*G09G 3/3233* (2016.01)
*G09G 3/3208* (2016.01)

(52) U.S. Cl.
CPC ..... *G09G 3/3208* (2013.01); *G09G 3/3233* (2013.01); *G09G 2320/0233* (2013.01);
(Continued)

(58) Field of Classification Search
None
See application file for complete search history.

(56) References Cited

U.S. PATENT DOCUMENTS 5,534,892 A * 7/1996 Tagawa ..... G06F 3/0412 178/20.01
2003/0048238 A1 3/2003 Tsuge et al.
(Continued)

FOREIGN PATENT DOCUMENTS

CA 2520624 A1 3/2006
CN 101615379 A 12/2009
(Continued)

OTHER PUBLICATIONS

Office Action dated Mar. 16, 2016 from the German Patent Office in counterpart German application No. 102013112721.5.

*Primary Examiner* — Temesghen Ghebretinsae
*Assistant Examiner* — Karin Kiyabu
(74) *Attorney, Agent, or Firm* — Morgan, Lewis & Bockius LLP

(57) ABSTRACT

An organic light emitting display device includes a display panel having a plurality of pixels provided with a pixel circuit to operate an organic light emitting diode, and a driving circuit to drive the display panel, wherein 'n' horizontal sensing lines are formed in the display panel, and a method for driving the display device includes: dividing the 'n' horizontal sensing lines formed in the display panel into a plurality of blocks; and sequentially or non-sequentially sensing the plurality of blocks via the sensing lines, wherein the plurality of blocks are sensed in order from the first to the last of the 'n' sensing lines by a sequential or non-sequential method.

16 Claims, 9 Drawing Sheets

(52) U.S. Cl.
CPC ..... *G09G 2320/0295* (2013.01); *G09G 2320/045* (2013.01)

(56) References Cited

U.S. PATENT DOCUMENTS

| | | | | |
|---|---|---|---|---|
| 2006/0221015 | A1* | 10/2006 | Shirasaki | G09G 3/325 345/77 |
| 2008/0062139 | A1* | 3/2008 | Hotelling | G02F 1/13338 345/173 |
| 2009/0309818 | A1 | 12/2009 | Kim | |
| 2010/0073346 | A1* | 3/2010 | Min | G09G 3/3291 345/211 |
| 2010/0085282 | A1* | 4/2010 | Yu | G09G 3/3233 345/76 |
| 2011/0007067 | A1 | 1/2011 | Ryu et al. | |
| 2011/0090158 | A1 | 4/2011 | Omori et al. | |
| 2011/0122119 | A1 | 5/2011 | Bae et al. | |
| 2011/0157069 | A1 | 6/2011 | Zhuang | |
| 2011/0187677 | A1* | 8/2011 | Hotelling | G06F 3/0412 345/174 |
| 2011/0205250 | A1 | 8/2011 | Yoo et al. | |
| 2011/0254871 | A1 | 10/2011 | Yoo et al. | |
| 2011/0273408 | A1 | 11/2011 | Ra et al. | |
| 2011/0279437 | A1 | 11/2011 | Komiya et al. | |
| 2011/0298836 | A1* | 12/2011 | Komiya | G09G 3/3233 345/690 |
| 2012/0050217 | A1* | 3/2012 | Noguchi | G06F 3/0412 345/174 |
| 2012/0056835 | A1 | 3/2012 | Choo | |
| 2012/0162104 | A1* | 6/2012 | Chang | G06F 3/0412 345/173 |
| 2012/0169704 | A1 | 7/2012 | Chung | |
| 2012/0169785 | A1 | 7/2012 | Kawabe | |
| 2013/0181969 | A1* | 7/2013 | Kishi | G09G 3/3233 345/212 |
| 2016/0019827 | A1* | 1/2016 | Lee | G09G 3/3208 345/204 |

FOREIGN PATENT DOCUMENTS

| | | | | |
|---|---|---|---|---|
| CN | 102074189 | A | 5/2011 | |
| CN | 102163402 | A | 8/2011 | |
| CN | 102222463 | A | 10/2011 | |
| JP | 2011237754 | A | 11/2011 | |
| KR | 20080094240 | A | 10/2008 | |
| TW | 200951933 | A | 12/2009 | |
| TW | 201118849 | A | 6/2011 | |
| TW | 201133449 | A | 10/2011 | |
| WO | WO-2012053462 | A1 * | 4/2012 | G09G 3/3233 |

* cited by examiner

< sensing order of 4 block >

1 → (N/4+1) → (2N/4+1) → (3N/4+1) →
2 → (N/4+2) → (2N/4+2) → (3N/4+2) →
3 → (N/4+3) → (2N/4+3) → (3N/4+3) →

< sensing order of 8 block >

1 → (N/8+1) → (2N/8+1) → (3N/8+1) → (4/8+1) → (5N/8+1) → (6N/8+1) → (7/8+1) →
2 → (N/8+2) → (2N/8+2) → (3N/8+2) → (4/8+2) → (5N/8+2) → (6N/8+2) → (7/8+2) →
3 → (N/8+3) → (2N/8+3) → (3N/8+3) → (4/8+3) → (5N/8+3) → (6N/8+3) → (7/8+3) →

METHOD OF DRIVING ORGANIC LIGHT EMITTING DISPLAY DEVICE

CROSS REFERENCE TO RELATED APPLICATIONS

This application is a continuation application of copending U.S. application Ser. No. 14/108,356, filed on Dec. 17, 2013 which claims the benefit of priority of Korean Patent Application No. 10-2012-0149827 filed on Dec. 20, 2012, both of which are hereby incorporated by reference as if fully set forth herein.

BACKGROUND

Field of the Disclosure

Embodiments relate to an organic light emitting display device, including a method of driving an organic light emitting display device that prevents a sensing line from being discerned by a real-time sensing process for external compensation, to thereby improve picture quality.

Discussion of the Related Art

With reference to FIG. 1, which is a circuit diagram illustrating a pixel of an organic light emitting display device according to the related art, each pixel of a display panel may include a first switching thin film transistor (TFT) (ST1), a second switching TFT (ST2), a driving TFT (DT), a capacitor (Cst), and an organic light emitting diode (OLED).

The first switching TFT (ST1) may be switched by a scan signal (or gate driving signal) supplied to a gate line GL. As the first switching TFT (ST1) is turned on, a data voltage Vdata supplied to a data line DL is accordingly supplied to the driving TFT (DT).

The driving TFT (DT) may be switched by the data voltage Vdata supplied from the first switching TFT (ST1). A data current I_oled flowing to the organic light emitting diode (OLED) may be controlled by switching the driving TFT (DT).

The capacitor (Cst) may be connected between gate and source terminals of the driving TFT (DT), wherein the capacitor (Cst) stores a voltage corresponding to the data voltage Vdata supplied to the gate terminal of the driving TFT (DT), and turns on the driving TFT (DT) by the use of stored voltage.

A first driving power VDD, which is applied through a power line PL, may be supplied to the source terminal of the driving TFT (DT). The organic light emitting diode OLED may be electrically connected between a cathode power source (VSS) and the source terminal of the driving TFT (DT), wherein the organic light emitting diode (OLED) may emit light in response to the data current (I_oled) supplied from the driving TFT (DT).

The organic light emitting display device according to the related art may control an intensity of the data current (I_oled) flowing from the first driving power (VDD) to the organic light emitting diode (OLED) by switching the driving TFT (DT) according to the data voltage (Vdata), whereby the organic light emitting diode (OLED) emits light and thereby displays an image.

However, in the organic light emitting display device according to the related art, the characteristics of the driving TFT (DT), for example, threshold voltage (Vth) and mobility, may be differently shown by each pixel due to nonuniformity in a process of manufacturing the TFT. Accordingly, even though the data voltage Vdata may be identically applied to the driving TFT (DT) for each pixel, it can be difficult to realize uniform picture quality due to a deviation of the current flowing in the organic light emitting diode (OLED).

In order to overcome this problem, there may be provided a second switching TFT (ST2). As the second switching TFT (ST2) is switched by a sensing signal applied to a sensing signal line (SL), the data current (I_oled) supplied to the organic light emitting diode (OLED) is supplied to an analog-to-digital converter (ADC) of a drive integrated circuit (drive IC). In this case, the sensing signal line (SL) can be formed in the same direction as the gate line (GL).

After completing a process of manufacturing the display panel, variations in the characteristics among the driving TFTs (DT) of all the pixels may cause spots or stains on a screen. In order prevent the spots or stains, it is required to measure and compensate for the threshold voltage (Vth) and mobility of the driving TFT (DT) of all the pixels before a product shipment.

FIG. 2 illustrates a method of driving displaying and sensing modes in the organic light emitting display device according to the related art.

With reference to FIG. 2, in the driving mode, an image may be displayed by programming the data voltages Vdata based on video data from the first data line to the last data line for a time period of N frames.

In the sensing mode, the sensing signal may be supplied to one or more sensing lines of all the sensing lines for a blank period between an (n)th frame and an (n+1)th frame (for example, if driven by 120 Hz, about 360 us), thereby performing a real-time sensing process.

The real-time sensing process may have the following steps.

First, a sensing pre-charging voltage (Vpre_s) may be supplied to all the pixels or some of the pixels (P) performed with the sensing process for the blank period between the (n)th frame and the (n+1)th frame. By selectively switching the second switching TFT (ST2) in all the pixels or some of the pixels, a voltage charged in a reference voltage line (RL) can be detected. Then, the detected voltage may be converted into compensation data corresponding to threshold voltage and mobility of the driving TFT (DT) for each pixel (P).

Thereafter, the pixels may be sequentially sensed by each one horizontal line during the plurality of blank periods, to thereby sense the threshold voltage and mobility of the driving TFT (DT) for all the pixels of the display panel. Then, the data voltage (Vdata) applied to the pixel can be compensated by the use of compensation voltage based on the detected threshold voltage/mobility. In this case, the compensation data may be generated based on the threshold voltage/mobility detected by sensing.

FIG. 3 illustrates that the sensing line on the screen may be discerned by the real-time sensing process.

In FIG. 3, the current is not flowing in the pixel (P) performed with the sensing process during the blank period. A luminance of the pixels (P) positioned along the line in which the sensing process is performed may be decreased by 5% in comparison to that of the normal line. As the real-time sensing process is sequentially performed by each one horizontal line, the sensing line on the screen is discerned.

SUMMARY

Accordingly, embodiments are directed to a method of driving an organic light emitting display device that substantially obviates one or more problems due to limitations and disadvantages of the related art.

An aspect of the embodiments is to provide a method of driving an organic light emitting display device, which facilitates to prevent a sensing line from being discerned by a real-time sensing process for an external compensation.

Another aspect of the embodiments is to provide a method of driving an organic light emitting display device, which facilitates preventing picture quality from deteriorating by a real-time sensing process for an external compensation.

Additional advantages and features of the embodiments will be set forth in part in the description which follows and in part will become apparent to those having ordinary skill in the art upon examination of the following or may be learned from practice of the embodiments. The objectives and other advantages of the embodiments may be realized and attained by the structure particularly pointed out in the written description and claims hereof as well as the appended drawings.

To achieve these and other advantages and in accordance with the purpose of the embodiments, as embodied and broadly described herein, there may be provided a method of driving an organic light emitting display device including a display panel having a plurality of pixels provided with a pixel circuit for operating an organic light emitting diode, and a driving circuit for driving the display panel, that may include dividing 'n' horizontal lines formed in the display panel into a plurality of blocks; and sequentially or non-sequentially sensing the plurality of blocks, wherein the plurality of blocks are sensed in order from the first sensing line to the last sensing line by a sequential or non-sequential method.

It is to be understood that both the foregoing general description and the following detailed description are exemplary and explanatory and are intended to provide further explanation of the embodiments as claimed.

BRIEF DESCRIPTION OF THE DRAWINGS

The accompanying drawings, which are included to provide a further understanding of the embodiments and are incorporated in and constitute a part of this application, illustrate example embodiment(s) and together with the description serve to explain principles of the embodiments. In the drawings.

DETAILED DESCRIPTION

Reference will now be made in detail to the exemplary embodiments, examples of which are illustrated in the accompanying drawings. The same or similar reference numbers may be used throughout the drawings to refer to the same or like parts.

The term of a singular expression should be understood to include a multiple expression as well as the singular expression if there is no specific definition in the context. If using the term such as "the first" or "the second", it is to separate any one element from other elements. Thus, a scope of claims is not limited by these terms.

Also, it should be understood that the term such as "include" or "have" does not preclude existence or possibility of one or more features, numbers, steps, operations, elements, parts or their combinations.

It should be understood that the term "at least one" includes all combinations related with any one item. For example, "at least one among a first element, a second element and a third element" may include all combinations of the two or more elements selected from the first, second and third elements as well as each element of the first, second and third elements.

Hereinafter, a method of driving an organic light emitting display device according to example embodiments will be described in detail with reference to the accompanying drawings.

According to a position of a circuit of compensating for a deviation in the characteristics of pixel, there may be an internal compensation method and an external compensation method. In the internal compensation method, a compensation circuit for compensating the deviation in the characteristics of pixel may be positioned inside the pixel. In the external compensation method, a compensation circuit for compensating the deviation in the characteristics of pixel may be positioned outside the pixel. Herein, the embodiments may relate to a method of driving an organic light emitting display device using the external compensation method.

Figure 1:
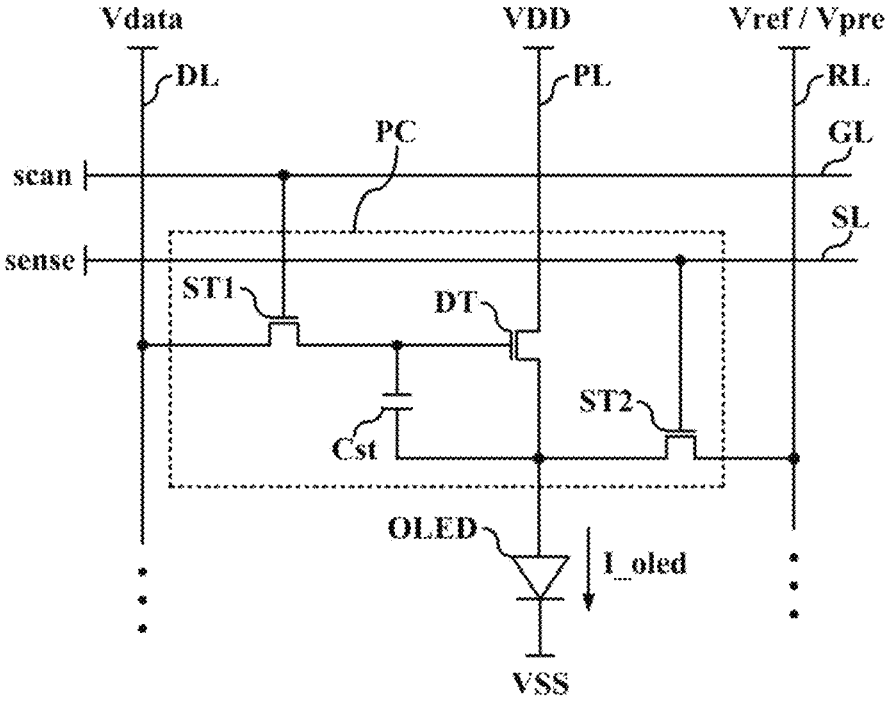
FIG. 1 Related Art
FIG. 1 is a circuit diagram illustrating a pixel of an organic light emitting display device according to the related art.
Figure 2:
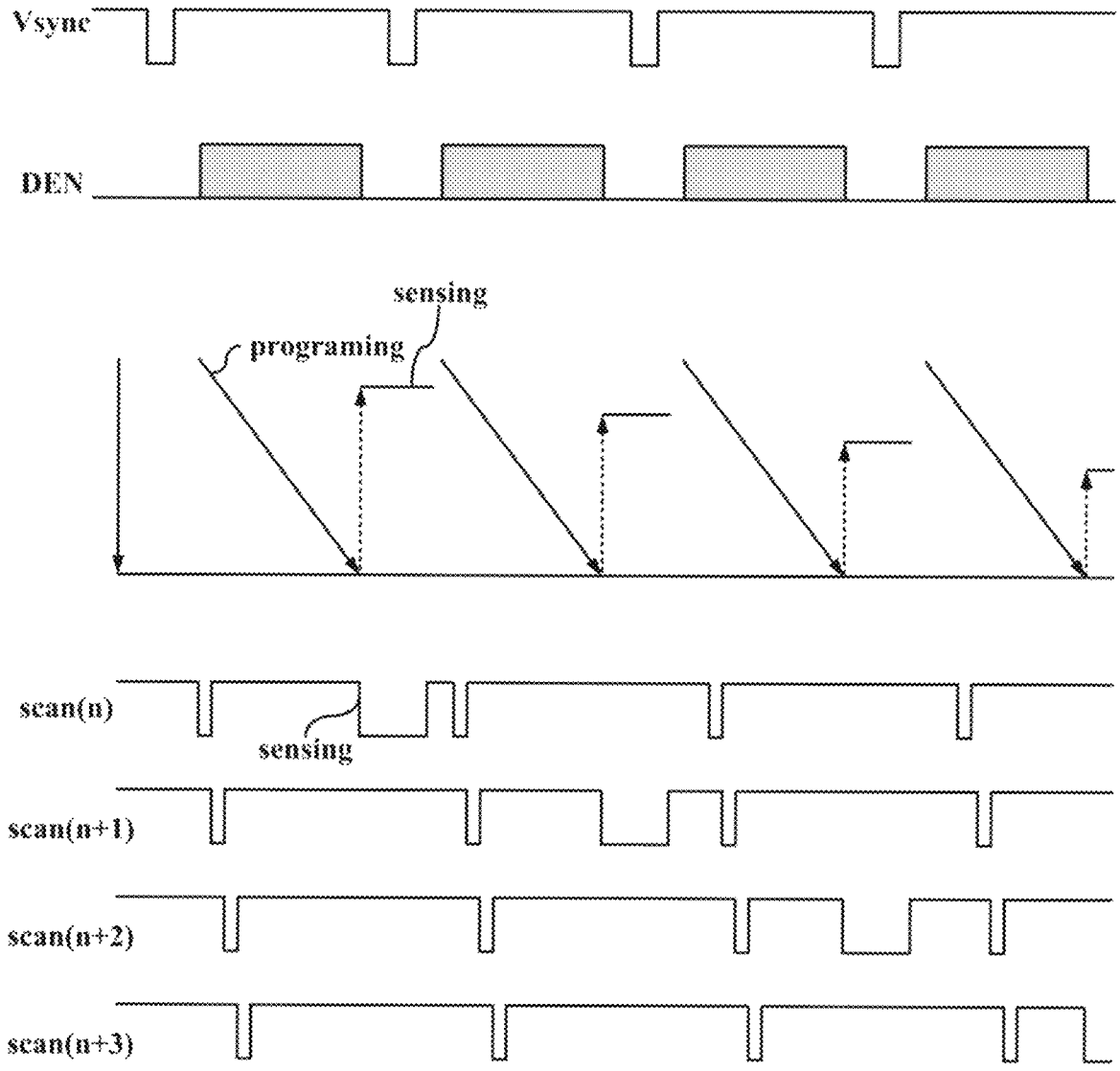
FIG. 2 Related Art
FIG. 2 illustrates a method of driving displaying and sensing modes in the organic light emitting display device according to the related art.
Figure 3:
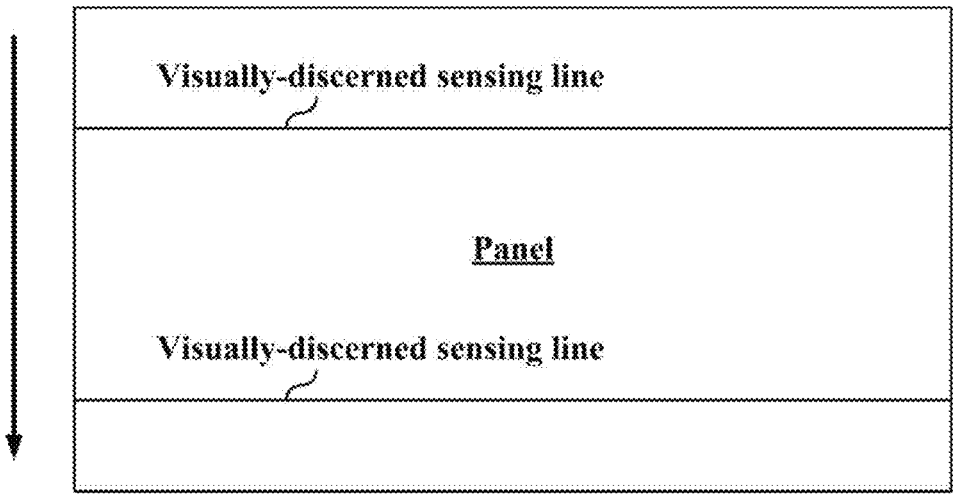
FIG. 3 Related Art
FIG. 3 illustrates a sensing line on a screen discerned by a real-time sensing process according to the related art.
Figure 4:
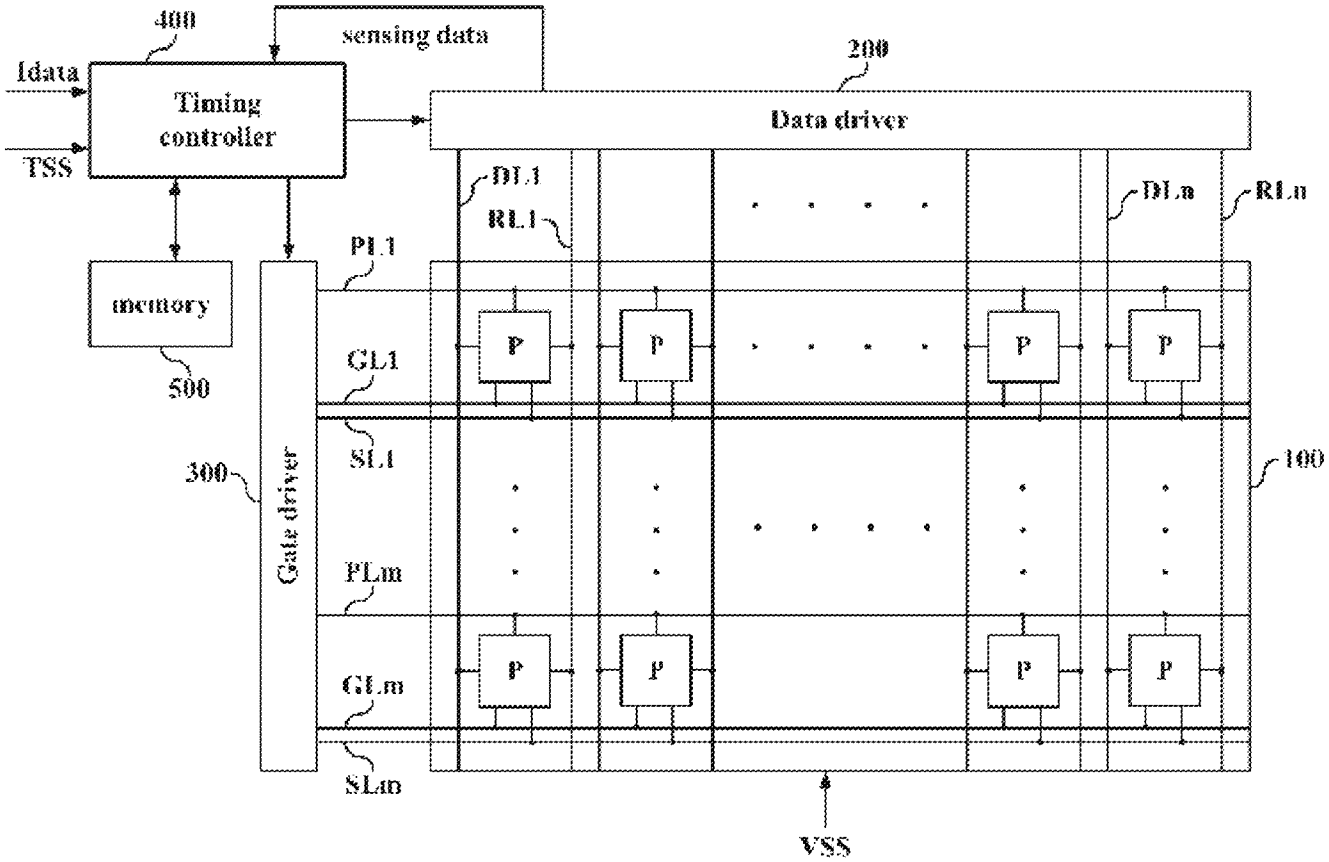
FIG. 4 illustrates an organic light emitting display device according to one embodiment.
Figure 5:
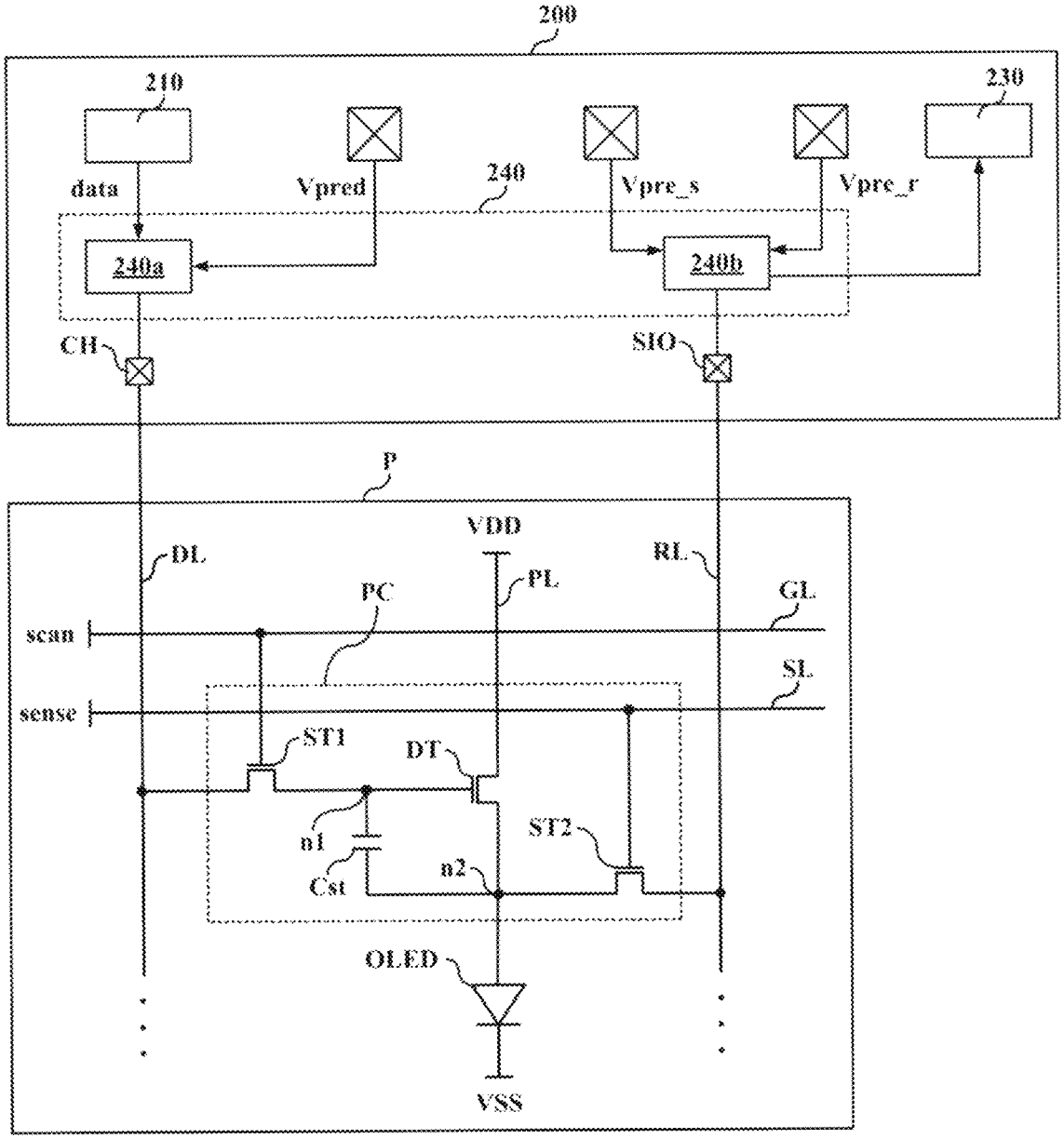
FIG. 5 is a circuit diagram illustrating a pixel structure and a data driver of the organic light emitting display device according to an embodiment.

FIG. 4 illustrates an organic light emitting display device according to an example embodiment. FIG. 5 is a circuit diagram illustrating a pixel structure and a data driver of the organic light emitting display device according to an embodiment.

With reference to FIGS. 4 and 5, the organic light emitting display device according to an embodiment may include a display panel 100 and a panel driver.

The panel driver may include a data driver 200, a gate driver 300, a timing controller 400, and a memory 500 for storing compensation data therein.

The display panel 100 may include a plurality of gate lines (GL), a plurality of sensing signal lines (SL), a plurality of data lines (DL), a plurality of driving power lines (PL), a plurality of reference voltage lines (RL), and a plurality of pixels (P).

Each of the pixels (P) may be any one of a red, green, blue and white pixel. A unit pixel for displaying an image may comprise adjacent red, green and blue pixels. According to another example, a unit pixel for displaying an image may comprise adjacent red, green, blue and white pixels.

Each of the pixels (P) may be formed in a pixel region defined on the display panel 100. On the display panel 100, there may be the plurality of gate lines (GL), the plurality of sensing signal lines (SL), the plurality of data lines (DL), the plurality of driving power lines (PL), and the plurality of reference voltage lines (RL), so as to define the pixel region.

The plurality of driving power lines (PL) may be formed in parallel to the gate line (GL), wherein the driving power line (PL) may supply a first driving power (VDD) to the pixel (P).

The plurality of gate lines (GL) and the plurality of sensing signal lines (SL) may be formed in a first direction (for example, horizontal direction) of the display panel 100. In this case, a scan signal (gate driving signal) is applied from the gate driver 300 to the gate line (GL), and a sensing signal is applied to the sensing signal line (SL).

The plurality of data lines (DL) may be formed in a second direction (for example, a vertical direction) of the display panel 100, that is, the plurality of data lines (DL) may be provided to cross the plurality of gate lines (GL) and the plurality of sensing signal lines (SL). In this case, a data voltage (Vdata) may be supplied from the data driver 200 to the data line (DL). The data voltage (Vdata) has a voltage level obtained by adding a source data voltage and a compensation voltage corresponding to a shift of a threshold voltage (Vth) in a driving TFT (DT) of the corresponding pixel (P). This compensation voltage will be described later.

The plurality of reference voltage lines (RL) may be respectively provided in parallel to the plurality of data lines (DL). The reference voltage lines (RL) may be selectively supplied with a display reference voltage (Vrep_r) or a sensing pre-charging voltage (Vpre_s) from the data driver 200. In this case, the display reference voltage (Vrep_r) may be supplied to each reference voltage line (RL) during a data charging period for each pixel (P). The sensing pre-charging voltage (Vpre_s) may be supplied to the reference voltage line (RL) during a sensing period for detecting threshold voltage/mobility of the driving TFT (DT) for each pixel (P).

As shown in FIG. 5, each of the plurality of pixels (P) may include a pixel circuit (PC).

The pixel circuit (PC) may charge a capacitor (Cst) with a differential voltage (Vdata-Vref) between the data voltage (Vdata) and a reference voltage (Vref). Also, the pixel circuit (PC) may supply a data current (I_oled) to an organic light emitting diode (OLED) according to the charging voltage of the capacitor (Cst) during a light emitting period.

The differential voltage (Vdata-Vref) between the data voltage (Vdata) and the reference voltage (Vref) may be charged in the capacitor (Cst) connected between gate and source electrodes of the driving TFT (DT). The driving TFT (DT) may be switched by the charging voltage of the capacitor (Cst). The organic light emitting diode (OLED) may emit light in response to the data current (I_oled) flowing from a first driving power (VDD) to a second driving power (VSS) through the driving TFT (DT).

The pixel circuit (PC) for each pixel (P) may include a first switching TFT (ST1), a second switching TFT (ST2), the driving TFT (DT) and the capacitor (Cst). In this case, the TFTs ST1, ST2, and DT may be N-type TFTs, for example, an Si TFT, poly-Si TFT, oxide TFT, organic TFT, etc., but are not limited to these types. For example, the TFTs ST1, ST2, and DT may be P-type TFTs.

The first switching TFT (ST1) may include a gate electrode connected to the gate line (GL), a source electrode (e.g, first electrode) connected to the data line (DL), and a drain electrode (e.g., second electrode) connected to a first node n1 connected to the gate electrode of the driving TFT (DT).

The first switching TFT (ST1) may be turned on by the scan signal of a gate-on voltage level supplied to the gate line (GL). If the first switching TFT (ST1) is turned on, the data voltage (Vdata) supplied to the data line (DL) may be supplied to the first node (n1), that is, the gate electrode of the driving TFT (DT).

The second switching TFT (ST2) may include a gate electrode connected to the sensing signal line (SL), a source electrode (first electrode) connected to the reference voltage line (RL), and a drain electrode (second electrode) connected to a second node (n2) connected to the driving TFT (DT) and the organic light emitting diode (OLED).

The second switching TFT (ST2) may be turned on by the sensing signal of a gate-on voltage level supplied to the sensing signal line (SL). If the second switching TFT (ST2) is turned-on, the sensing pre-charging voltage (Vpre_S) or the display reference voltage (Vpre_r), which is supplied to the reference voltage line (RL), may be supplied to the second node (n2).

The capacitor (Cst) may be connected between the gate and source electrodes of the driving TFT (DT). The capacitor (Cst) may be connected between the first node (n1) and the second node (n2). In this case, the differential voltage between the voltages respectively supplied to the first and second nodes (n1) and (n2) can be charged in the capacitor (Cst). The driving TFT (DT) may be switched by the voltage charged in the capacitor (Cst).

The gate electrode of the driving TFT (DT) may be connected to the drain electrode of the first switching TFT (ST1) and a first electrode of the capacitor (Cst) in common. Also, the drain electrode of the driving TFT (DT) may be connected to the driving power line (PL). The source electrode of the driving TFT (DT) may be connected to the drain electrode of the second switching TFT (ST2), a second electrode of the capacitor (Cst), and an anode of the organic light emitting diode (OLED) in common. As the driving TFT (DT) is turned-on by the voltage of the capacitor (Cst) every light emitting period, an amount of current flowing to the organic light emitting diode (OLED) may be controlled by the first driving power (VDD).

The organic light emitting diode (OLED) may be driven by the data current (I_oled) supplied from the pixel circuit (PC), that is, the driving TFT (DT), to thereby emit monochromatic light with a luminance corresponding to the data current (I_oled).

To this end, the organic light emitting diode (OLED) may include an anode electrode (not shown) which is connected to the second node (n2) of the pixel circuit (PC), an organic layer (not shown) which is formed on the anode electrode, and a cathode electrode (not shown) which is supplied with the second driving power (VSS) and formed on the organic layer.

In this case, the organic layer may be formed in a deposition structure of hole transport layer/organic light emitting layer/electron transport layer or a deposition structure of hole injection layer/hole transport layer/organic light emitting layer/electron transport layer/electron injection layer. Furthermore, the organic layer may include a functional layer for improving light-emitting efficiency and/or lifespan of the organic light emitting layer. Also, the second driving power (VSS) may be supplied to the cathode electrode of the organic light emitting diode (OLED) through a second driving power line (not shown) formed in a line shape.

The gate driver 300 may be operated in a driving mode (display mode) or a sensing mode according to a mode control of the timing controller 400. The gate driver 300 may be connected to the plurality of gate lines (GL) and the plurality of sensing signal lines (SL).

In case of the driving mode, the gate driver 300 may generate a scan signal (scan) of gate-on voltage level every one horizontal period according to a gate control signal (GCS) supplied from the timing controller 400, and then may sequentially supply the generated scan signal to the plurality of gate lines (GL).

While the scan signal (scan) has a gate-on voltage level during the data charging period for each pixel (P), the scan signal (scan) has a gate-off voltage level during the light emitting period for each pixel (P). The gate driver 300 may be a shift register for sequentially or non-sequentially outputting the scan signal (scan).

In case of the sensing mode, the gate driver 300 may generate the sensing signal (sense) of gate-on voltage level at every initialization period and sensing voltage charging period for each pixel (P), and then sequentially or non-sequentially supply the generated sensing signal (sense) to the plurality of sensing signal lines (SL).

In an example, in the sensing mode, if the sensing of pixels is sequentially performed every one horizontal line, the sensing line may be seen and discerned by a viewer. In order to overcome this problem, the entire line may be divided into a plurality of blocks (for example, four blocks or eight blocks), and the divided blocks may be sensed sequentially or non-sequentially.

For example, after sensing the first horizontal line of the first block, the first horizontal line of the second block is sensed, and then the first horizontal line of the third block is sensed, whereby the plurality of blocks are sensed in sequence. In this sensing mode, the scan signal and the sensing signal may be supplied to the gate line (GL) and the sensing signal line SL by the non-sequential method (or random method).

Meanwhile, if the 'm' horizontal lines are formed in each of the plurality of blocks, a sensing order of the 'm' horizontal lines in one block may be random. In case of the sensing mode, the scan signal and the sensing signal may be supplied to the gate line (GL) and the sensing signal line (SL) by the non-sequential method.

The gate driver 300 may be formed in an integrated circuit (IC) type, or may be directly formed on a substrate of the display panel 100 during a process of manufacturing the transistor for each pixel (P).

The gate driver 300 may be connected to the plurality of driving power lines (PL1 to PLm), and the gate driver 300 may supply the driving power (VDD), supplied from an external power supplier (not shown), to the plurality of driving power lines (PL1 to PLm).

In the sensing mode, the timing controller 400 may generate a data control signal (DCS) and a gate control signal (GCS) to detect threshold voltage/mobility of the driving TFT (DT) for each pixel (P) every one horizontal line on the basis of timing synchronous signal (TSS). By the use of data control signal (DCS) and gate control signal (GCS), the data driver 200 and the gate driver 300 may be operated in the sensing mode.

The timing controller 400 may operate each of the data driver 200 and the gate driver 300 in the driving mode. At a time point preset by a user or a timing point of detecting the threshold voltage/mobility of the preset driving TFT (DT), each of the data driver 200 and the gate driver 300 may be operated in the sensing mode by the timing controller 400.

The sensing mode may be performed at an initial driving time, a long-time driving end time, or a blank period of a frame for displaying an image on the display panel 100.

In the sensing mode at the initial driving time of the display panel 100 or the sensing mode at the long-time driving end time of the display panel 100, the timing controller 400 may sense the threshold voltage/mobility of the driving TFT (DT) for the predetermined number of pixels (P) during one frame.

During the plurality of frames, the process of sensing the threshold voltage/mobility of the driving TFT (DT) may be performed repetitively, thereby sensing the threshold voltage/mobility of the driving TFT (DT) for all the pixels (P) of the display panel 100.

In the sensing mode of the blank period, the timing controller 400 may sense the threshold voltage/mobility of the driving transistor (DT) for the pixel (P) formed in one horizontal line every blank period.

According to the above-mentioned method, the timing controller 400 may sense the threshold voltage/mobility of the driving transistor (DT) for all the pixels (P) of the display panel 100 all through the blank periods of the frames.

The timing synchronous signal (TSS) may be a vertical synchronous signal (Vsync), a horizontal synchronous signal (Hsync), a data enable signal (DE), a clock (DCLK), and etc. The gate control signal (GCS) may comprise a gate start signal and a plurality of clock signals. The data control signal (DCS) may comprise a data start signal, a data shift signal, and a data output signal.

In the sensing mode, the timing controller 400 may generate predetermined detection data, and supply the generated detection data to the data driver 200.

In the driving mode, the timing controller 400 may generate pixel data (DATA) by correcting input data (Idata), which is inputted externally, on the basis of detection data (Dsen) for each pixel (P) provided from the data driver 200 by the sensing mode. Then, the generated pixel data (DATA) may be supplied to the data driver 200.

In this case, the pixel data (DATA) to be supplied to each pixel (P) may have a voltage level in which a compensation voltage for compensating the threshold voltage/mobility of the driving TFT (DT) for each pixel (P) is reflected.

The input data (Idata) may comprise red, green, and blue input data to be supplied to one unit pixel. If the unit pixel comprises red, green, and blue pixels, one of the pixel data (DATA) may be red, green, or blue data. Meanwhile, if the unit pixel comprises red, green, blue, and white pixels, one of the pixel data (DATA) may be red, green, blue, or white data.

As shown in FIG. 5, the data driver 200 may be connected to the plurality of data lines (D1 to Dn), and the data driver 200 may be operated in the driving mode or the sensing mode according to the mode control of the timing controller 400.

The driving mode for displaying an image may be driven to have the data charging period for charging each pixel with the data voltage, and the light emitting period for operating the organic light emitting diode (OLED). Also, the sensing mode may be driven to have in an initialization period for initializing each pixel, a sensing voltage charging period, and a sensing period.

The data driver 200 may include a data voltage generator 210, a sensing data generator 230, and a switch 240.

The data voltage generator 210 may convert the input pixel data (DATA) into the data voltage (Vdata), and supply the data voltage (Vdata) to the data line (DL). To this end, the data voltage generator 210 may include a shift register, a latch, a grayscale voltage generator, a digital-to-analog converter (DAC), and an output part.

The shift register may generate a sampling signal, and the latch may latch the pixel data (DATA) according to the sampling signal. The grayscale voltage generator may generate a plurality of grayscale voltages by the use of reference gamma voltages, and the digital-to-analog converter (DAC) may select the grayscale voltage corresponding to the latched pixel data (DATA) among the plurality of grayscale voltages, and output the selected grayscale voltage as the data voltage (Vdata). Then, the output part may output the data voltage (Vdata) to the data line (DL).

The switch 240 may include a plurality of first switches 240*a* and a plurality of second switches 240*b*.

In the driving mode, the plurality of first switches 240*a* may switch the data voltage (Vdata) or reference voltage (Vpred), and then supply the switched data voltage (Vdata) or reference voltage (Vpred) to the data line (DL).

In the sensing mode, the plurality of second switches 240*b* may switch the display reference voltage (Vpre_r) or sensing pre-charging voltage (Vpre_s), and then supply the switched display reference voltage (Vpre_r) or sensing pre-charging voltage (Vpre_s) to the reference voltage line (RL). After floating the reference voltage line (RL), the floating reference voltage line (RL) may be connected to the sensing data generator 230, thereby sensing the corresponding pixel.

If the sensing data generator 230 is connected to the reference voltage line (RL) by the switching of the switch 240, the sensing data generator 230 may sense the voltage charged in the reference voltage line (RL). Then, the sensing data generator 230 generates sensing data of digital type corresponding to the sensed analog voltage, and then supplies the generated sensing data to the timing controller 400.

In this case, the voltage sensed by the reference voltage line (RL) may be determined by a ratio of the current flowing to the driving TFT (DT) according to a change of time to a capacitance of the reference voltage line (RL). In this case, the sensing data may be the data corresponding to the threshold voltage/mobility of the driving TFT (DT) for each pixel (P).

Figure 6:
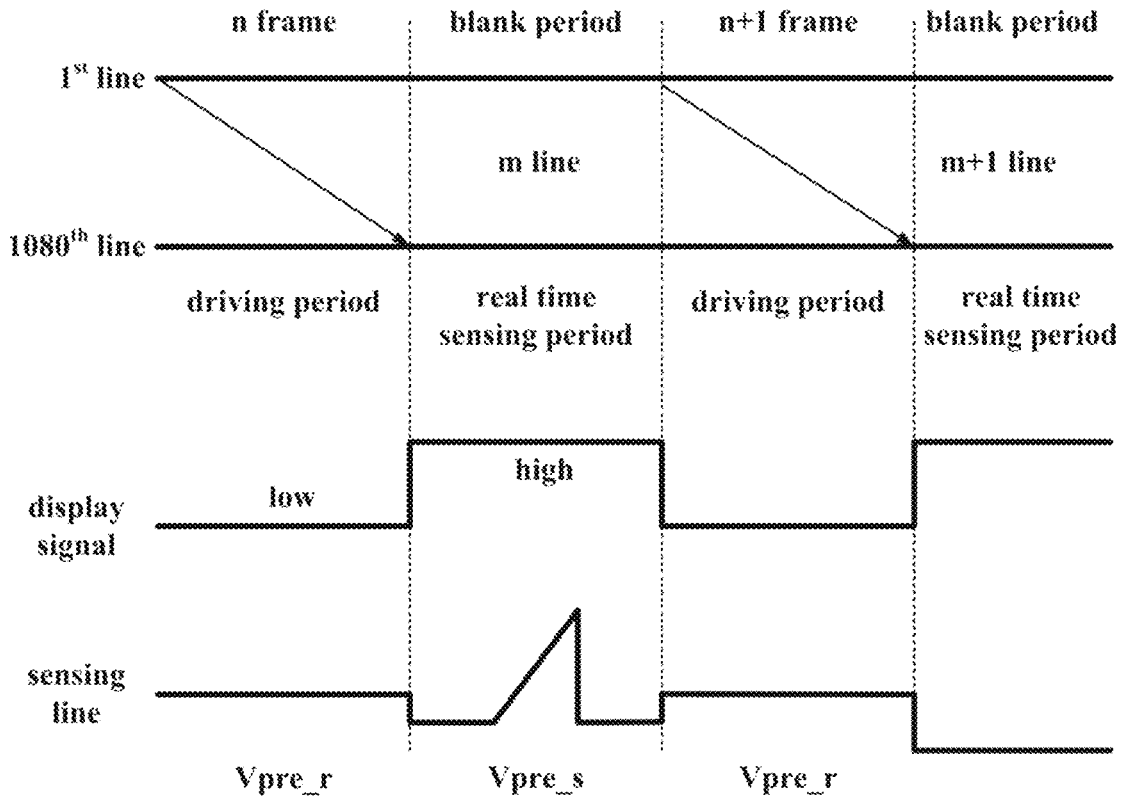
FIG. 6 illustrates a method of driving displaying and sensing modes in the organic light emitting display device according to an embodiment.

FIG. 6 illustrates a method of driving the displaying and sensing modes in the organic light emitting display device according to an example of the present embodiment. Hereinafter, a structure of the data driver 200 and a method of driving the displaying and sensing modes in the organic light emitting display device according to this present embodiment will be described with reference to FIG. 6.

In the driving mode for displaying an image, an image may be displayed by supplying the data voltage (Vdata) according to the video data from the first data line to the last data line for a time period of N frame. In this case, the sensing power line (SL) may be supplied with the display reference voltage (Vpre_r).

The plurality of second switches 240*b* may be switched during the blank period between the (n)th frame and the (n+1)th frame, whereby the sensing pre-charging voltage (Vpre_s) may be supplied to one sensing power line (SL) or a plurality of sensing power lines (SL). In one example, the sensing pre-charging voltage (Vpre_s) may be about 1V.

After floating the reference voltage line (RL) through the second switch 240*b*, the reference voltage line (RL) may be connected to the sensing data generator 230, thereby sensing the corresponding pixel.

The sensing data generator 230 may convert the voltage detected in the reference voltage line (RL) into the compensation data corresponding to the threshold voltage/mobility of the driving TFT (DT) for each pixel (P).

Figure 7:
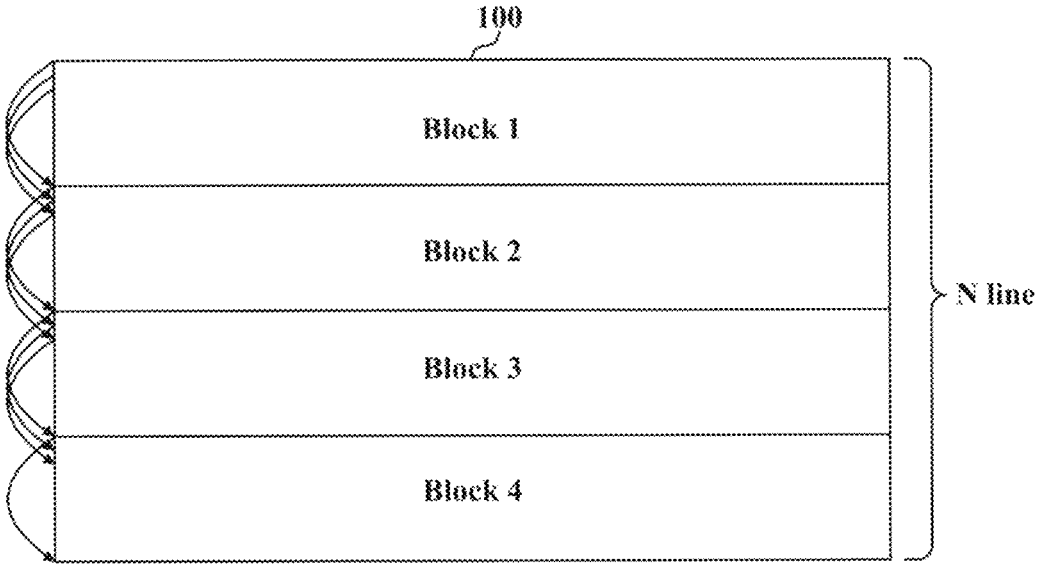
FIGS. 7 to 9 illustrate a method of driving the organic light emitting display device according to an embodiment, and show an example of a real-time sensing method.
Figure 8:
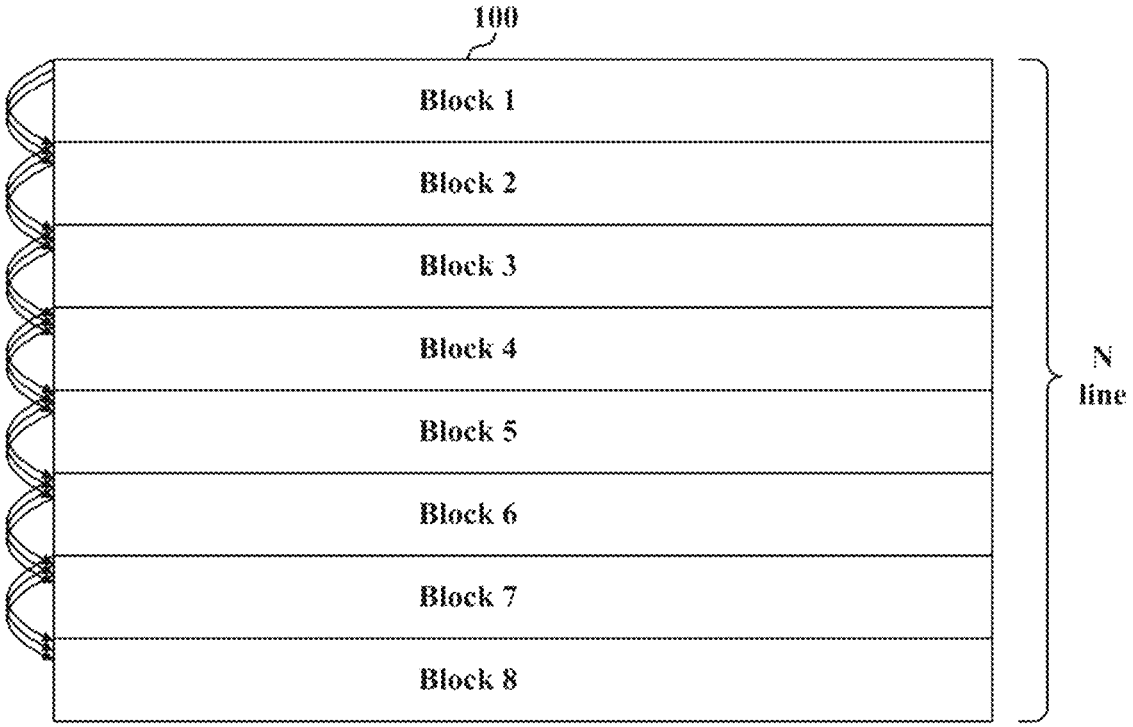
Figure 9:
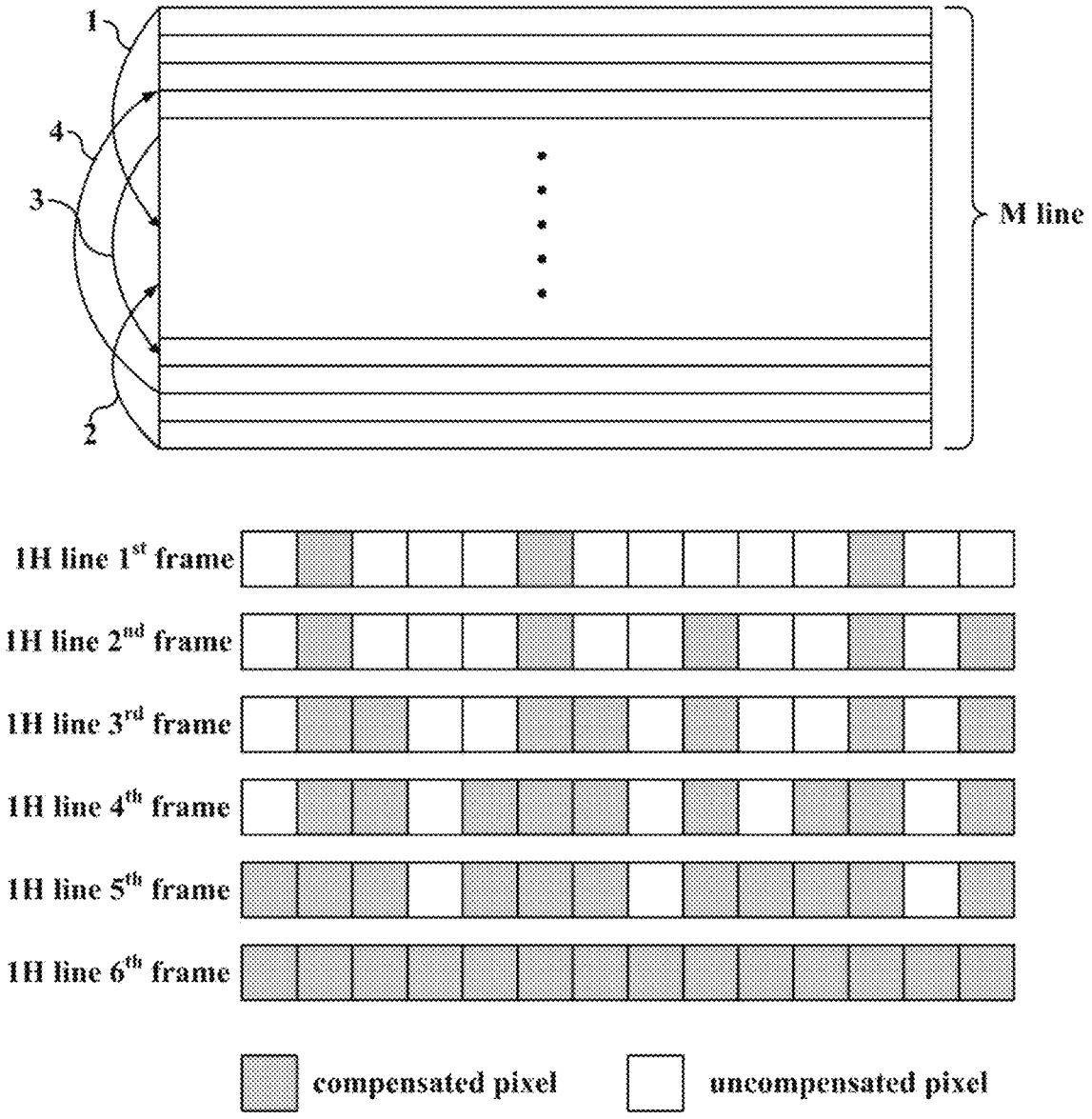

FIGS. 7 to 9 illustrate a driving method of the organic light emitting display device according to an example of the present embodiments, which explain the real-time sensing method.

With reference to FIG. 7, when sensing the characteristics of the driving TFT (DT) being driven, the current may not flow in the organic light emitting diode (OLED) positioned in the corresponding line of the sensing process. Thus, the sensing line may be discerned by a viewer because the luminance of the corresponding sensing line is relatively low compared to that of the neighboring lines with the normal luminance.

In order to overcome this problem, the horizontal lines of the display panel may be divided into the plurality of blocks, for example, the four blocks, and then the plurality of blocks may be sensed in sequence. That is, instead of continuously sensing the horizontal lines positioned in the same block, the horizontal lines in the different blocks may be sensed sequentially or non-sequentially.

For example, after sensing the first sensing line of the first block, the first sensing line of the second block may be sensed. Subsequently, the first sensing line of the third block may be sensed, and then the first sensing line of the fourth block may be sensed.

With the same method, after sensing the second sensing line of the first block, the second sensing line of the second block may be sensed. Subsequently, after sensing the second sensing line of the third block, the second sensing line of the fourth block may be sensed.

If the four blocks are sequentially sensed in order from the first sensing line to the last sensing line in each of the four blocks, the sensing process may be discontinuous due to the interval between each of the blocks. Thus, it is possible to prevent the sensing line of the screen from being discerned by the real-time sensing process for the external compensation.

It may be unnecessary to sense the pixels in ascending order from the first block to the fourth block. According to another example, it may be possible to non-sequentially or randomly sense the four blocks.

With reference to FIG. 8, the horizontal lines of the display panel may be divided into the plurality of blocks, for example, the eight blocks, and then the plurality of blocks may be sensed in sequence.

For example, after sensing the first sensing line of the first block, the first sensing line of the second block may be sensed. Then, after sensing the first sensing line of the third block, the first sensing line of the fourth block may be sensed. Subsequently, after sensing the first sensing line of the fifth block, the first sensing line of the sixth block may be sensed. Then, after sensing the first sensing line of the seventh block, the first sensing line of the eighth block may be sensed.

In the same method, after sensing the second sensing line of the first block, the second sensing line of the second block may be sensed. Then, after sensing the second sensing line of the third block, the second sensing line of the fourth block may be sensed. Subsequently, after sensing the second sensing line of the fifth block, the second sensing line of the sixth block may be sensed. Then, after sensing the second sensing line of the seventh block, the second sensing line of the eighth block may be sensed.

If the eight blocks are sequentially sensed in order from the first sensing line to the last sensing line in each of the eight blocks, the sensing process may be discontinuous due to the interval between each of the blocks. Thus, it is possible to prevent the sensing line of the screen from being discerned by the real-time sensing process for the external compensation.

It may be unnecessary to sense the pixels in ascending order from the first block to the eighth block. According to another example, it is possible to non-sequentially or randomly sense the eight blocks.

With reference to FIG. 9, the 'n' horizontal lines of the display panel are divided into the plurality of blocks, and the 'M' horizontal lines provided in each of the blocks may be sensed randomly.

For example, the plurality of blocks are sensed sequentially or non-sequentially. If one of the 'm' horizontal lines provided in the first block may be sensed in the non-sequential method during the first frame period, one of the 'm' horizontal lines provided in the second block may be sensed in the non-sequential method during the second frame period.

Instead of sensing the horizontal lines provided in the same block during the successive frame periods, the horizontal lines provided in the different blocks may be sensed to prevent the sensing line from being discerned by the real-time sensing process.

In this case, instead of sensing all the pixels provided in one horizontal line during one frame, the plurality of pixels formed one horizontal line may be sensed during the plurality of frames.

As shown in FIG. 9, the plurality of pixels formed in one horizontal line are distributed among and sensed during the plurality of frames. Then, the pixels performed with the sensing process are gradually increased in number, thereby performing the real-time sensing process for the external compensation. FIG. 9 illustrates the sensing method in which the pixels of one horizontal line are distributed among the six frames.

If the plurality of pixels formed in one horizontal line are distributed among and sensed during the plurality of frames, it is possible to prevent the sensing line from being seen and discerned by the real-time sensing process, but embodiments are not limited to the above. When the plurality of pixels formed in one horizontal line are distributed among and sensed during the plurality of frames, the number of frames is not limited, that is, the number of frames may be discretionally determined in consideration of the characteristics of the display panel and the sensing time.

Thus, the threshold voltage/mobility of the driving TFT (DT) for all the pixels of the display panel may be detected all through the blank periods of the frames, and then the data voltage (Vdata) applied to the pixel (P) may be compensated by the use of compensation data based on the detected threshold voltage/mobility. Thus, the external compensation can be performed with high efficiency without any discernment of the sensing line, thereby preventing a picture quality from being deteriorated by the real-time sensing process for the external compensation.

According to the method of driving the organic light emitting display device of the embodiments, it is possible to prevent the sensing line from being discerned by the real-time sensing process for the external compensation, and thus prevent the picture quality from being deteriorated when the real-time sensing process for the external compensation is performed, thereby realizing high driving reliability of the display panel.

It will be apparent to those skilled in the art that various modifications and variations can be made in the embodiments without departing from the spirit or scope of the inventions. Thus, it is intended that the present invention covers the modifications and variations of this invention provided they come within the scope of the appended claims and their equivalents.

What is claimed is:

1. A method of driving an organic light emitting display device comprising a display panel including a plurality of pixels arranged in 'n' (n is an integer greater than 3) horizontal sensing lines, a driving circuit for driving the plurality of pixels, wherein the plurality of pixels arranged in the 'n' horizontal sensing lines are divided into a plurality of blocks, and each block has pixels arranged in 'm' (m is an integer greater than 1 and smaller than n) sensing lines, the method including:

sensing characteristics of driving thin film transistors (TFTs) of pixels arranged in one sensing line of the 'm' sensing lines in one block of the plurality of blocks by using reference voltage lines parallel to data lines; and sensing characteristics of driving TFTs of pixels arranged in one sensing line of 'm' sensing lines in another block of the plurality of blocks by using the reference voltage lines, wherein the characteristics of the driving TFTs of the pixels arranged in the one sensing line of the another block are sensed after sensing the characteristics of the driving TFTs of the pixels arranged in only the one sensing line of the one block and before sensing characteristics of driving TFTs of pixels arranged in any other sensing line of the one block, and wherein the plurality of blocks are sensed non-sequentially or the 'm' sensing lines in one of the plurality of blocks are sensed non-sequentially or the plurality of blocks and the 'm' sensing lines in one of the plurality of blocks are sensed non-sequentially.

2. The method of claim 1, wherein the sensing in the one block senses the characteristics of driving TFTs of pixels arranged in kth (k is an integer equal to or greater than 1 and smaller than m) sensing line of the 'm' sensing lines in the one block by using the reference voltage lines, and the sensing in the another block senses the characteristics of driving TFTs of pixels arranged in kth sensing line of the 'm' sensing lines in the another block by using the reference voltage lines.

3. The method of claim 1, wherein the sensing in the one block senses the characteristics of driving TFTs of pixels arranged in kth (k is an integer equal to or greater than 1 and smaller than m) sensing line of the 'm' sensing lines in the one block by using the reference voltage lines; and the sensing in the another block senses the characteristics of driving TFTs of pixels arranged in the one sensing line of (k+1)th to mth sensing lines in the another block by using the reference voltage lines.

4. The method of claim 1, wherein the plurality of blocks includes 1 to 'p' (p is an integer greater than 3) blocks.

5. The method of claim 4, wherein the one block is a first block and the another block is a second block.

6. The method of claim 4, wherein the one block is a qth block and the another block is first to (q−1)th and (q+1)th to mth block.

7. The method of claim 4, wherein the one block is a qth block and the another block is one of first to (q−1)th and (q+1)th to mth block.

8. The method of claim 1, wherein the sensing in the one block senses the characteristics of driving TFTs of pixels arranged in the one sensing line of the 'm' sensing lines in the one block during a plurality of frames by using the reference voltage lines.

9. An organic light emitting display device comprising:

a display panel including a plurality of pixels arranged in 'n' (n is an integer greater than 3) horizontal sensing lines, a driving circuit for driving the plurality of pixels, the plurality of pixels arranged in the 'n' horizontal sensing lines are divided into a plurality of blocks, and each block has pixels arranged in 'm' (m is an integer greater than 1 and smaller than n) sensing lines;

a driving circuit to drive the display panel, the driving circuit configured to:

sense characteristics of driving thin film transistors (TFTs) of pixels arranged in one sensing line of the 'm' sensing lines in one block of the plurality of blocks by using reference voltage lines parallel to data lines; and sense characteristics of driving TFTs of pixels arranged in one sensing line of 'm' sensing lines in another block of the plurality of blocks by using the reference voltage lines, wherein the characteristics of the driving TFTs of the pixels arranged in the one sensing line of the another block are sensed after sensing the characteristics of the driving TFTs of the pixels arranged in only the one sensing line of the one block and before sensing characteristics of the driving TFTs of pixels arranged in any other sensing line of the one block, and wherein the plurality of blocks are sensed non-sequentially or the 'm' sensing lines in one of the plurality of blocks are sensed non-sequentially or the plurality of blocks and the 'm' sensing lines in one of the plurality of blocks are sensed non-sequentially.

10. The organic light emitting display device of claim 9, wherein the driving circuit is configured to sense the characteristics of driving TFTs of pixels arranged in kth (k is an integer equal to or greater than 1 and smaller than m) sensing line of the 'm' sensing lines in the one block by using the reference voltage lines, and sense the characteristics of driving TFTs of pixels arranged in kth sensing line of the 'm' sensing lines in the another block by using the reference voltage lines.

11. The organic light emitting display device of claim 9, wherein the driving circuit is configured to sense the characteristics of driving TFTs of pixels arranged in kth (k is an integer equal to or greater than 1 and smaller than m) sensing line of the 'm' sensing lines in the one block by using the reference voltage lines, and sense the characteristics of driving TFTs of pixels arranged in the one sensing line of (k+1)th to mth sensing lines in the another block by using the reference voltage lines.

12. The organic light emitting display device of claim 9, wherein the plurality of blocks includes 1 to 'p' (p is an integer greater than 3) blocks.

13. The organic light emitting display device of claim 12, wherein the one block is a first block and the another block is a second block.

14. The organic light emitting display device of claim 12, wherein the one block is a qth block and the another block is first to (q−1)th and (q+1)th to mth block.

15. The organic light emitting display device of claim 12, wherein the one block is a qth block and the another block is one of first to (q−1)th and (q+1)th to mth block.

16. The organic light emitting display device of claim 9, wherein the driving circuit is configured to sense the characteristics of driving TFTs of pixels arranged in the one sensing line of the 'm' sensing lines in the one block during a plurality of frames by using the reference voltage lines.

* * * * *